United States Patent [19]

McDonough

[11] 3,964,815

[45] June 22, 1976

[54] INSULATION PIERCING TERMINAL

[75] Inventor: Cletus McDonough, Elmhurst, Ill.

[73] Assignee: Molex Incorporated, Lisle, Ill.

[22] Filed: Feb. 26, 1975

[21] Appl. No.: 553,083

[52] U.S. Cl. ..... 339/97 C; 29/630 A; 174/84 C; 339/276 T

[51] Int. Cl.[2] ..... H01R 11/08

[58] Field of Search ..... 339/97, 95, 223, 276; 29/628, 630 A; 174/84 C, 90

[56] References Cited

UNITED STATES PATENTS

| | | | |
|---|---|---|---|
| 2,600,012 | 6/1952 | Macy | 339/276 T |
| 2,680,235 | 6/1954 | Pierce | 339/276 T |
| 2,908,887 | 10/1959 | Broske | 339/97 C |

*Primary Examiner*—Roy Lake
*Assistant Examiner*—Neil Abrams
*Attorney, Agent, or Firm*—Louis A. Hecht

[57] ABSTRACT

An insulation piercing terminal for use with insulation clad wire. The terminal includes a contact portion and a wire gripping portion that is adapted to be crimped onto the wire. The wire gripping portion includes a central elongated wire supporting area defining the bottom support for the wire and a pair of insulation piercing wings having sharp ends. The piercing wings extend outwardly in opposite directions from the wire supporting area around half the wire and meet in the location on top of the wire where they pierce the insulation at the top location so that the ends of the wings extend downwardly into and contact the wire and then bottom on the wire supporting area.

A method of crimping the above terminal onto the wire including the steps of providing a flat conductive blank, placing the insulation clad wire on the wire supporting area, forming each piercing wing around half the wire so that the ends thereof meet at a location on top of the wire, curling the piercing wings so that the ends thereof point generally downwardly toward the wire supporting area, and inserting the ends of the wings into the wire through the insulation until they bottom on the wire supporting area.

3 Claims, 7 Drawing Figures

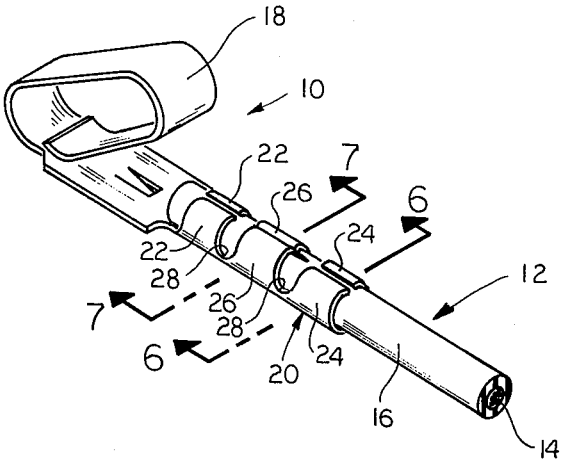
FIG. 1
FIG. 2
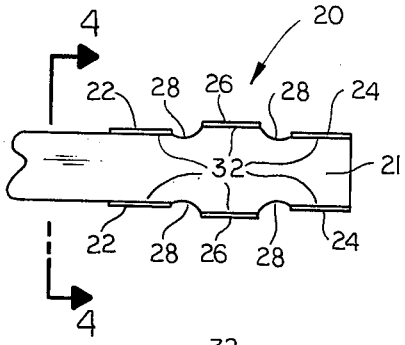
FIG. 4
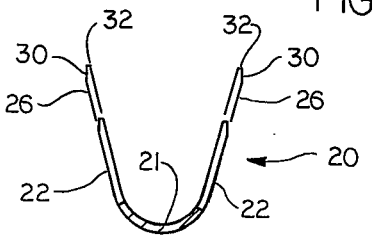
FIG. 3
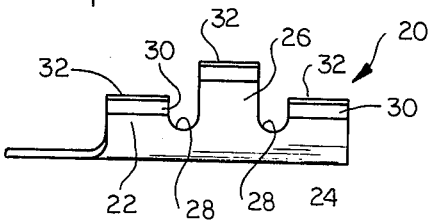
FIG. 6
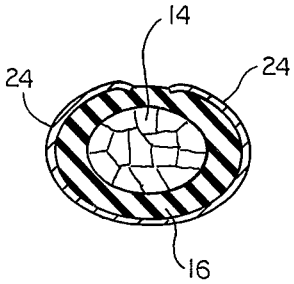
FIG. 5
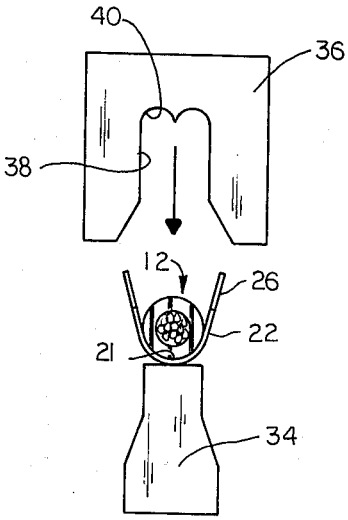
FIG. 7
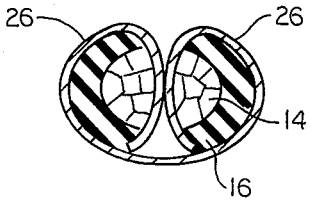

INSULATION PIERCING TERMINAL

BACKGROUND OF THE INVENTION

1. Field of the Invention

The present invention relates generally to electrical connectors, and, more particularly, to crimp-on type terminals that are adapted to pierce the insulation of an insulation clad wire.

2. Brief Description of the Prior Art

Conventional crimp-on type terminals have been used for many years to provide an electrical termination on a discrete strand of insulation clad wire. Terminals of this type generally have a contact portion and a wire gripping portion. However, the end of the wire had to be stripped of its insulation before the terminal could be crimped.

Because of the cost of stripping the ends of wire, terminals having wire gripping portions with means for piercing through the insulation of an unstripped insulation clad wire to make contact with the conductors have been developed. However, the previous designs have not been widely accepted especially for the stranded or discrete wire types of conductors. The reason for this lack of acceptance is caused in great part by the shifting of the wire conductors and the extruding of the insulation during and after a crimping operation. In addition, the prior art insulation piercing terminals have not been successful in offering long-term, safe and reliable termination to a very fine stranded wire.

SUMMARY OF THE INVENTION

It is therefore the principal object of the present invention to provide a crimp-on type insulation piercing terminal having an improved wire gripping portion that prevents extrusion of insulation, provides a reliable electrical connection and is easily crimped onto individual insulation clad stranded wires. This object of the invention is accomplished by one form currently contemplated which provides for a wire gripping portion including a central elongated wire supporting area having a longitudinal axis and defining a bottom support for a wire, and a pair of insulation piercing wings having sharp ends, each wing extending outwardly in opposite directions from the wire supporting area. The wings surround half the wire and meet at a location on top of the wire and pierce the insulation at the top location so that the ends of the wings extend downwardly into and contact the wire and bottom on the wire supporting area so that each wing encloses substantially one half the cross section of the wire.

Another object of the present invention is to provide an improved method of crimping the above type of terminal onto an insulation clad wire. The method includes the steps of providing a flat conductive blank with a central wire supporting area and a pair of insulation piercing wings extending outwardly therefrom, placing the insulation clad wire on the wire supporting area, forming each piercing wing around one half the wire so that the ends thereof meet at a location on top of the wire, curling the piercing wings so that the ends thereof point generally downwardly toward the wire supporting areas, and inserting the ends of the wings downwardly into the wire through the insulation until they bottom on the wire supporting area.

BRIEF DESCRIPTION OF THE DRAWINGS

FIG. 1 is a perspective view of the terminal of the present invention crimped onto an insulation clad wire;

FIG. 2 is a plan view of the wire gripping portion of the terminal of the present invention;

FIG. 3 is a side view of the wire gripping portion of the terminal of the present invention;

FIG. 4 is a sectional view taken generally along the line 4—4 of FIG. 2;

FIG. 5 is a generally schematic end view of the wire gripping portion of the terminal of the present invention during a crimping operation;

FIG. 6 is a sectional view taken generally along the line 6—6 of FIG. 1; and

FIG. 7 is a sectional view taken generally along the line 7—7 of FIG. 1.

DESCRIPTION OF THE PREFERRED EMBODIMENT

Turning to FIG. 1 in greater detail, a crimp-on type terminal, generally designated 10, is shown crimped onto an insulation clad wire, generally designated 12. The wire 12 is discrete and includes a plurality of metal conductors 14 surrounded by an extrudable insulation 16 such as plastic or the like. The terminal 10 is seen to generally include a forward contact portion 18 which is adapted to contact a part of an electrical circuit and a rearward wire gripping portion which is adapted to be crimped onto the wire 12. The wire gripping portion 20 has insulation piercing means that pierces insulation 16 to contact conductors 14 in a manner which will be described in greater detail hereinafter.

Turning now to FIGS. 2–4 in greater detail, the wire gripping portion 20 is seen to include a central elongated wire supporting area 21 having two pair of identical insulation gripping wings 22 and 24 and an intermediate pair of insulation piercing wings 26 between wings 22 and 24. Each wing of each pair of wings 22, 24 and 26, extend outwardly in opposite directions from the wire supporting area 21. Insulation gripping wings 22 and 24 extend a shorter distance from the wire supporting area 21 than the piercing wings 26.

Spaces 28 are provided between wings 22 and wings 26 and also between wings 26 and wings 24. The purpose of these spaces 28 is to separate the wings and permit full forming of the wings 22, 24 and 26 during a crimp operation.

Each of the respective wings 22, 24, and 26 are provided with a coined portion 30 on the outside edge thereof which results in a land 32 on the top edge of each wing. The land 32 is normally less than one-half the thickness of the blank stock used. This land aids in the formation of the "F" type crimp as well as providing a sharper edge for easier piercing of the insulation 16 and conductors 14.

As best seen in FIGS. 1 and 7, the insulation piercing wings 26 are adapted to extend and wrap around half of the wire 12 until the wings 26 meet at a location on top of the wire where the ends thereof pierce the insulation 16 at that top location so that the ends of the wings 26 extend downwardly into the wire 12 and contact the conductors 14. The ends of the wings 26 bottom on the wire supporting area 21 and curl away from each other. Each piercing wing encloses substantially one half the cross section of the wire 12 and completely confines the conductors 14 and maintains intimate contact between the conductors 14 and the terminal 10.

As best shown in FIGS. 1 and 6, the insulation gripping wings 22 and 24 are adapted to surroundingly engage the outside surface of the insulation 16 and slightly dig into the insulation 16 on top of the wire 12. The insulation wings 22 and 24 act as a restraining means to the wire 12 on either side of the piercing wings 26. This prevents motion of the wire 12 and ensures that the contact between the piercing wings 26 and the conductors 14 is not moved by vibration or strain on the wire 12.

The terminal 10 is crimped onto the wire 12 by means of a crimp tool as shown in FIG. 5. The crimp tool includes an anvil 34 underlying a forming punch 36. The forming punch 36 has a box section 38 and a curling section 40 for purposes which will become more apparent hereinafter.

A generally flat metal blank is provided with the wings 22, 24 and 26 extending from the wire supporting area 21 as described above. The blank is folded about its longitudinal axis into a generally U-shaped configuration as best seen in FIG. 4. The blank is then placed on top of the anvil 34 and an unstripped wire 12 is placed in the wire supporting area 21. The forming punch 36 is then actuated against the terminal 10 and wire 12 and anvil 34 to effect the crimping operation.

During the crimping operation, the box section 38 of the forming punch 36 causes all of the wings 22, 24 and 26 to generally wrap around the outside surface of the insulation surface 16. The insulation gripping wings 22 and 24 are of a length to reverse form slightly by the curling section 40 of the forming punch 36 thus firmly gripping the insulation but not penetrating to the conductors 14. On the other hand, the piercing wings 26 are sufficiently long so that they will receive a full reverse form from the curling section 40 of the forming punch 36.

The reverse-curl form on the piercing wings 26 causes the ends thereof to point generally downward toward the longitudinal axis of the wire supporting area 21. Upon further downward motion of the punch 36, the ends of the piercing wings 26 are inserted into the wire 12 through the insulation 16 into contact with the conductors 14 as best shown in FIG. 7 until they bottom on the wire supporting area 21.

I claim:

1. An insulation piercing terminal for use with insulation clad wire, said terminal including a contact portion and a wire gripping portion that is adapted to be crimped onto said wire, the improvement in said wire gripping portion comprising:

a central elongated wire supporting area having a longitudinal axis and defining a bottom support for the wire;

a pair of insulation piecing wings having sharp ends, each extending outwardly in opposite directions from the wire supporting area around half the wire, meeting at a location on top of the wire, piercing the insulation at said top location so that the ends of the wings extend downwardly into and contact the wire, and contacting the wire supporting area so that each piercing wing encloses substantially one half of the cross section of the wire; and two pairs of insulation gripping wings one on either side of and spaced from said piercing wings, each insulation gripping wing of each pair extending outwardly in opposite directions from the wire supporting area a lesser distance than the insulation piercing wings each gripping wing being wrapped about the clad wire.

2. A method of crimping a terminal including a contact portion and a wire gripping portion onto an insulation clad wire comprising the steps of:

providing a flat conductive terminal blank wherein said wire gripping portion includes a central wire supporting area having a longitudinal axis, a pair of insulation piercing wings with sharp ends each extending outwardly in opposite directions from said wire supporting area, and two pairs of insulation gripping wings each extending outwardly in opposite directions from said wire supporting area a lesser distance than said piercing wings;

placing the insulation clad wire on the wire supporting area; and crimping the terminal onto the wire including first simultaneously wrapping each piercing wing around half the wire so that the ends thereof meet at a location on top of the wire, curling the piercing wings so that the ends thereof point generally downwardly toward the longitudinal axis, and wrapping each of said insulation gripping wings around the outside of the clad wire, and subsequently inserting the ends of the piercing wings into the wire through the insulation, until said piercing wings bottom on said wire supporting area.

3. The method of claim 2 including the step of partially folding said wire gripping portion about its longitudinal axis into a generally U-shaped configuration before placing the wire thereon.

* * * * *